US006377762B2

(12) United States Patent
Kobayashi et al.

(10) Patent No.: US 6,377,762 B2
(45) Date of Patent: Apr. 23, 2002

(54) IMAGE FORMING APPARATUS CONTROLLING IMAGE FORMING CONDITIONS BASED ON DETECTED TONER CONCENTRATION BEFORE AND AFTER STOPPAGE

(75) Inventors: Yoshiaki Kobayashi, Numazu; Ichiro Ozawa, Funabashi, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/771,884

(22) Filed: Jan. 30, 2001

(30) Foreign Application Priority Data

Feb. 1, 2000 (JP) ..... 2000-028941

(51) Int. Cl.[7] ..... G03G 15/00; G03G 15/08
(52) U.S. Cl. ..... 399/46; 399/44; 399/61
(58) Field of Search ..... 399/43, 44, 46, 399/62, 61, 63, 64

(56) References Cited

U.S. PATENT DOCUMENTS 5,081,498 A * 1/1992 Bares ..... 399/61 X
5,146,274 A * 9/1992 Hattori et al. ..... 399/44
5,734,407 A * 3/1998 Yamada et al. ..... 399/46 X
5,887,220 A * 3/1999 Nagaoka ..... 399/46
5,966,557 A * 10/1999 Wada ..... 399/43
6,104,892 A 8/2000 Kobayashi et al. ..... 399/63

* cited by examiner

*Primary Examiner*—Joan Pendegrass
(74) *Attorney, Agent, or Firm*—Fitzpatrick, Cella, Harper & Scinto

(57) ABSTRACT

An image forming apparatus is provided with a function for forming an image on a recording medium such, as a sheet or the like. The image forming apparatus includes an image forming unit for forming an image on a recording material including an image bearing member. A developing unit develops an electrostatic image formed on the image bearing member by a developer. A density detection unit detects a developer density inside the developing unit. The density detection unit detects a parameter relating to physical property of the developer based on a previous detection value detected by the density detection unit during a previous image forming drive operation by the image forming unit and before the previous image forming drive operation stops. The detection unit also detects a next detection value detected by the density detecting unit after the previous image forming drive operation stops and before a next image forming drive operation by the image forming unit starts. Accordingly, the image forming condition of the next image forming drive operation is controlled to be variable by a control unit based on the detection values.

17 Claims, 8 Drawing Sheets

IMAGE FORMING APPARATUS CONTROLLING IMAGE FORMING CONDITIONS BASED ON DETECTED TONER CONCENTRATION BEFORE AND AFTER STOPPAGE

BACKGROUND OF THE INVENTION

1. Field of the Invention

The present invention relates to an image forming apparatus, for example, such as a copier, a printer or a facsimile device or the like which is provided with a function for forming an image on a recording medium such as a sheet or the like.

2. Related Background Art

Generally, a developing apparatus provided with the image forming apparatus of an electrophotographic system or an electrostatic recording system uses a two-component developer, whose main components are toner grains and carrier grains. In particular, a color image forming apparatus for forming a full color or a multicolor image based on the electrophotographic system uses the two-component developer from the standpoint of color tones or the like for almost all the developing apparatuses.

As is well known, the toner density of the two-component developer, that is, a ratio of the weight of toner grains to the total weight of carrier grains and toner grains is very important for stabilizing an image quality.

The toner grains of the developer are consumed at a developing time and the toner density is changed. For this reason, it is necessary that, by using an automatic toner replenishment control device (ATR), the toner density of the developer is accurately detected from time to time and, in response to the changes detected, the toner replenishment is performed so that the toner density is controlled always to be constant and the image quality is maintained.

Thus, in order to compensate for the changes in the toner density by development inside the developing apparatus, that is, in order to control the toner amount to be supplied to the developing apparatus, heretofore in the past a detection device of the toner density inside the developing container and a toner control device have been put to practical use with a variety of systems employed.

For example, when a developer carrier (hereinafter, referred to as a "developing sleeve" as there are many cases where the developing sleeve is generally used), or the developer in close proximity to the developer carrying passage of a developer container and conveyed on the developing sleeve or the developer inside the developer container are exposed to light, its reflectance varies depending on the toner density. By utilizing this fact, a developer density control apparatus is used for detecting and controlling the toner density.

Or, the toner density control apparatus of an inductance detection system or the like are used whereby the actual toner density is detected by a detection signal from an induction head, which detects an apparent permeability due to the mixing ratio of a magnetic carrier of the developer and nonmagnetic toner and converts the apparent permeability to an electric signal, based on the comparison to a reference value, the toner is replenished.

Also, there are such system or the like (hereinafter, referred to as a "patch detection system") where a patch image density formed on an image bearing member (hereinafter, referred to as a "photosensitive drum" as there are many cases where the photosensitive drum is generally used) is read by a light source arranged in a position opposite to its surface and by a sensor which receives its reflected light and, after converted into a digital signal by an A/D converter, is sent to a CPU where it is compared to an initialization value and, when the density is higher than the initialization value, the toner replenishment is stopped until the initialization value is restored, and when the density is lower than the initialization value, the toner is compulsorily replenished until the initialization value is restored with a result that the toner density is indirectly maintained at a desired value.

Again, there is a developer density control apparatus referred to as a video count system where the consumption amount of the toner is estimated from the number of video counts of the image density of the image information signal read by a CCD or the like and the corresponding amount of the toner is replenished.

The system for indirectly controlling the toner density from the above described patch image density has a problem in that a space for forming the patch image or the space for installing detecting means is difficult to obtain with the miniaturization of the copier or the image forming apparatus.

Also, because the toner replenishment by the video count system counts the toner replenish amount and replenishes the toner for each image forming drive operation, when the toner is consumed in a large amount due to the image of a high density, it is quickly controlled to become an adequate toner density in contract to the former two systems.

However, depending on the accuracy of a toner hopper for replenishing the toner, when there arises any deviation between the toner consumption calculated from the video count and the replenishment by the toner hopper while the image forming sheets are produced in large quantities, the toner deviates gradually from the initial adequate developer density, thereby making it difficult to control the developer density by the video count system alone.

On the other hand, the above described light detection developer density control apparatus or the developer density control system of the above described inductance detection system (hereinafter, referred to as "induction detection system ATR") have no problems as described above and there is no need to secure an extra space because the detection apparatus can be arranged inside the developing apparatus.

Nevertheless, the above described conventional technologies involved the following problems.

When an image forming drive operation is performed by using the light detection system effective for the miniaturization of the apparatus or the inductance detection system as described above, after the developer is left under a high humidity environment and additionally after the developer is left for a long period at a time when the image forming drive operation is producing tens of thousands of sheets, the phenomenon occurred where an image density is extremely high and the toner is attached to a white ground portion or an omission of images or the like due to an inadequate transfer is observed.

Against this phenomenon, the present inventors conducted a detailed study and ascertained that the above-described phenomenon was due to the lowering of the triboelectrification amount of the developer, the details of which will be described as follows.

Following the trend of a high quality image of recent years, the grain size of the two-component developer (toner, carrier) has also been miniaturized and, as a result, the surface areas of the toner and the carrier per unit weight have increased.

When such a developer is used, the rising of the triboelectrification amount is improved. However, when the developer is left under the high humidity environment, its hygroscopic property becomes high in proportion to its large surface area and its triboelectrification amount tends to be lowered.

Particularly, when the image forming drive operation exceeds tens of thousands of sheets, the carrier surface begins to be spent due to accumulation of external additives or the like and even the rising of the triboelectrification amount is lowered when the developer is left under the high humidity environment for a long period.

In spite of the fact that the physical property of the developer change as described above, when the image taking is performed in the same condition (for example, a developing contrast potential, a fog taking potential and a transfer condition) as the process condition before the developer is left, the above described phenomenon occurs.

This phenomenon is alleviated against density and transfer property by keeping a volume of the toner sizing constant on the photosensitive member by using a patch detection system. However, heretofore in the past the light detection system and the induction detection system have only kept the toner density inside the developer container constant and it was impossible for them to control other process conditions.

SUMMARY OF THE INVENTION

The present invention is achieved to solve the problems of the above described conventional technologies and its object is to provide the image forming apparatus capable of preventing faulty images immediately after the developer is left for a long period especially under the high humidity environment and obtaining good images with always a steady image density and without fog or roughness.

DETAILED DESCRIPTION OF THE PREFERRED EMBODIMENTS

Hereinafter, the preferred embodiments of the present invention will be described illustratively in detail with reference to the drawings. However, it should be noted that the size, the material and the form of the components described in these embodiments and their relative arrangements or the like are changed from time to time depending on the configuration of the apparatus adapted to the present invention and the various conditions, and that the scope of the present invention should not be limited to the following preferred embodiments.

The image forming apparatus which the present invention can adapt may be configured in such a manner that latent images corresponding to image information signals are formed, for example, on an image bearing member such as a photosensitive member, an inductive member or the like and these latent images are developed by a developing apparatus using a binary developer mainly composed of toner grains and carrier grains so as to form developing images (toner images), and these toner images are transferred on a recording material such as paper or the like, thereby making them permanent images by fixing means.

(Embodiment 1)

First, the whole configuration of the image forming apparatus adapted to the present invention will be described with reference to FIG. 1. While an embodiment 1 shows the case where the present invention is adapted to a digital copier of an electrophotostatic system, the present invention can be equally adapted to a variety of other image forming apparatuses of the electrophotostatic system and an electrostatic recording system.

Figure 1:
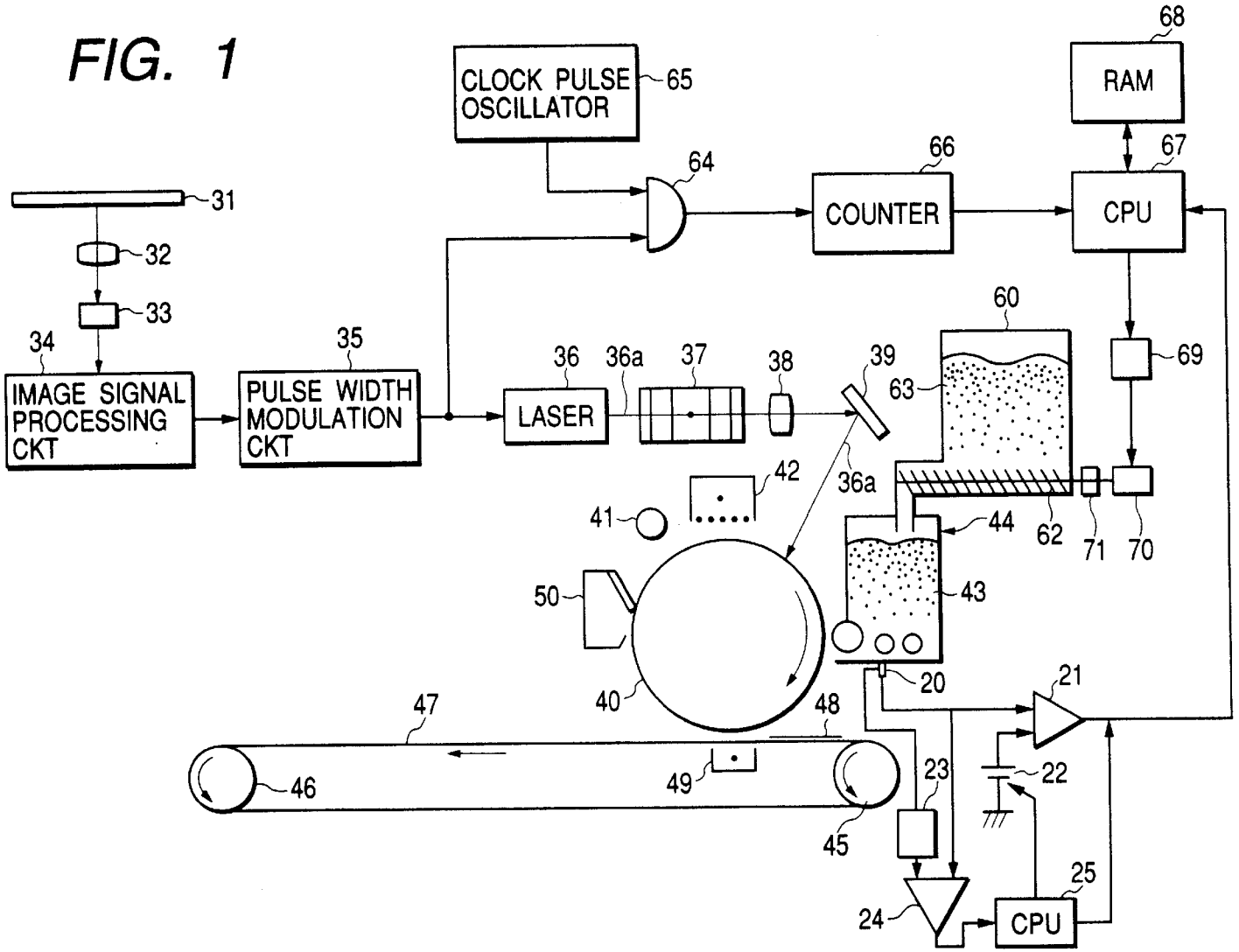
FIG. 1 is a schematic diagram showing an image forming apparatus to which the present invention is adopted.

In FIG. 1, the image of an original 31 to be recopied is projected to an image pick-up element 33 such as a CCD or the like by a lens 32. This image pick-up element 33 decomposes the image of the original 31 into a number of picture elements and generates a photoelectric transfer signal corresponding to the density of each picture element.

The analogue image signal outputted from the image pick-up element 33 is sent to an image signal processing circuit 34, where it is converted into a picture element image signal having an output level corresponding to the density of the picture element for each picture element and sent to a pulse width modulation circuit 35.

This pulse width modulation circuit 35 forms and outputs a laser drive pulse of the width (time length) corresponding to the level of each picture element image signal inputted.

Figure 3A:
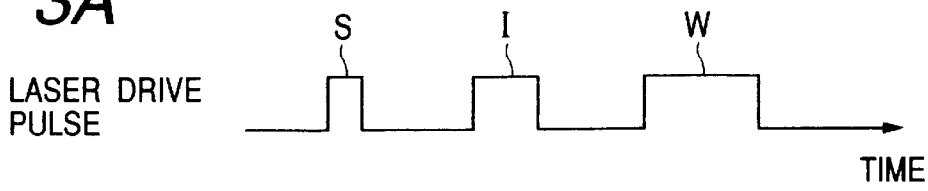
FIGS. 3A, 3B, 3C and 3D are drawings explaining a methods of counting image information signals.
Figure 3B:
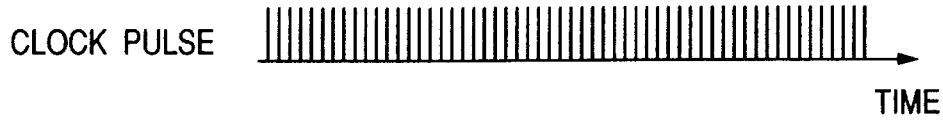
Figure 3C:
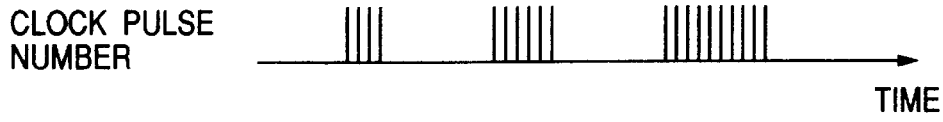

That is, as shown in FIG. 3A, it forms a drive pulse W having a wider width for the picture element image signal of the high density, a drive pulse S having a narrower width for the picture element signal of the low density and a drive pulse I having a medium width for the picture element signal of a medium density, respectively.

The laser drive pulse outputted from the pulse width modulation circuit 35 is supplied to a semiconductor laser 36 and makes the semiconductor laser 36 emit a light only for a time corresponding to that pulse width. Accordingly, the semiconductor laser 36 is driven for a longer time against the picture element of the high density and driven for a shorter time against the picture element of the low density.

Therefore, a photosensitive drum 40 as an image bearing member is exposed by an optical system, which will be described later, in a longer range in the main scanning direction for the picture element of the high density, while it is exposed in a shorter range in the main scanning direction for the picture element of the low density. That is, the dot size of the electrostatic latent image varies corresponding to the density of the picture element.

Figure 3D:
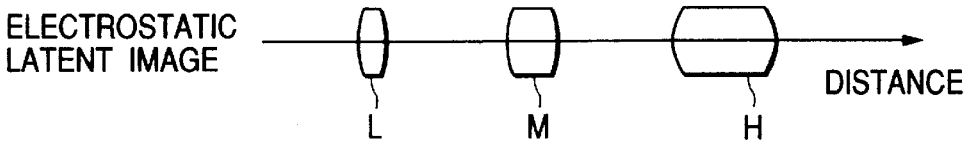
Figure 4:
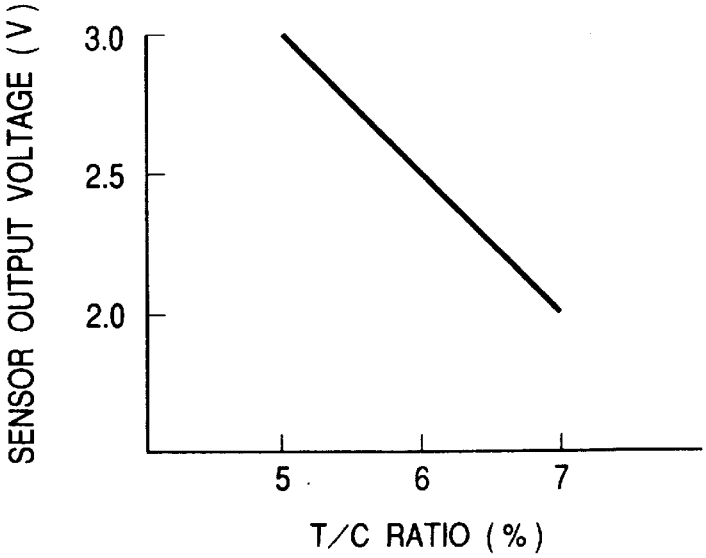
FIG. 4 is a drawing showing changes in a detection signal from an inductance head against the changes in a toner density of a developer.

Therefore, it is only natural that the consumption amount of toner for the picture element of the high density is larger than that for the picture element of the low density. Note that L, M and H show the electrostatic latent images for the picture elements of the low, the medium and the high density in FIG. 3D, respectively.

A laser beam 36*a* radiated from the semiconductor 36 is swept by a rotary polygon mirror 37 and a spot-image-formed on the photosensitive drum 40 by a lens 38 such as a f/θ lens or the like and a fixed mirror 39 which directs the laser beam 36*a* to the direction of the photosensitive drum 40. In this manner, the laser beam 36*a* scans this drum 40 in the direction (main scanning direction) approximately parallel with the rotary axis of rotation of the photosensitive drum 40 and forms an electrostatic latent image.

The photosensitive drum 40 has amorphous silicon, selenium, OPC or the like on its surface and is an electrophotographic photosensitive drum, which rotates in the direction of the arrow. After electrification is removed from the photosensitive drum 40 by an exposing device 41 as an exposing means, it is uniformly charged by a primary charging device 42 as a charging means. After that, it is exposure-scanned by the laser beam modulated corresponding to the above-described image information signal, thereby the electrostatic latent image corresponding to the image information signal is formed.

This electrostatic latent image is reverse-developed by a developing device 44 as developing means using a two-component developer 43 where toner grains and carrier grains are mixed so that a visualized image (a toner image) is formed. Here, what is meant by the reversal developing is the developing method for attaching the toner charged with the same polarity as the latent image to the area exposed by a light of the photosensitive member and visualizing this area.

This toner image is a transferring material bearing belt 47, which is hooked between two rollers 45 and 46, and is transferred by a transfer charging device 49 onto a transferring material 48 as a recording member held on the transferring material bearing belt 47, which is endlessly driven in the direction as shown by the arrow.

Note that, in order to simplify the description, only one image forming apparatus (including the photosensitive drum 40, the exposing device 41, the primary charging device 42, the developing device 44 or the like) is shown. However, in the case of a color image forming apparatus, four image forming stations, for example, for each color of cyan, magenta, yellow and black are arranged in order along with its moving direction on the transferring material bearing belt 47 and the electrostatic latent images for each color which color-decomposed the image of the original are formed in order on the photosensitive drum of each image forming station and developed by the developing device having the corresponding color toner and transferred in order on the transferring material 48 which is held and conveyed by the transferring material bearing belt 47.

The transferring material 48 where this toner image was transferred is separated from the transferring material bearing belt 47 and conveyed to a fixing device not shown and fixed and converted into a permanent image. Also, the residual toner remaining on the photosensitive drum 40 after the transfer is removed by a cleaner 50 thereafter.

Figure 2:
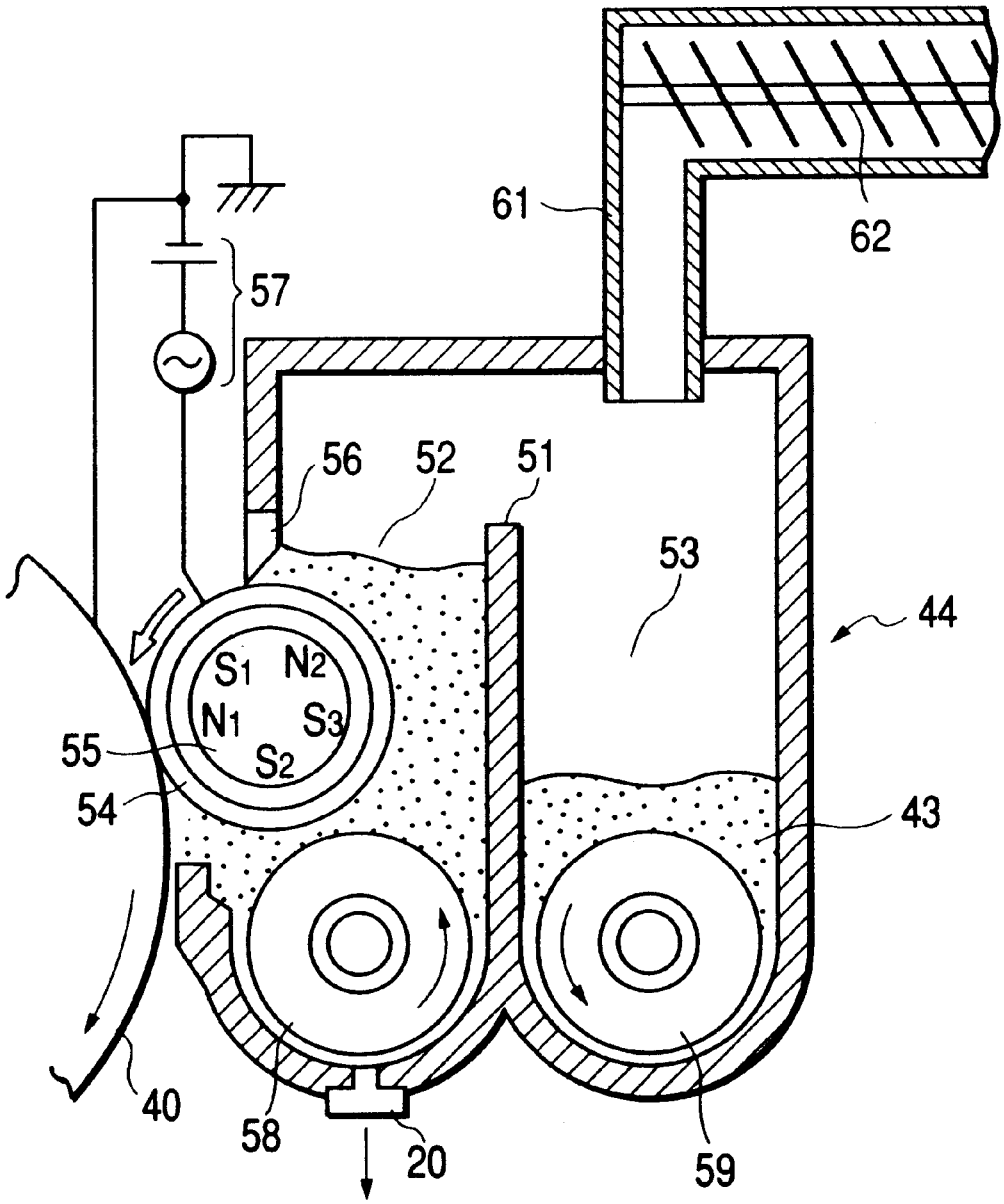
FIG. 2 is a schematic diagram showing a developing device to which the present invention is adapted.

One example of the above described developing device 44 is shown in FIG. 2. As shown in the drawing, the developing device 44 is arranged opposite to the photosensitive drum 40, and the inside thereof is zoned the first chamber (developing chamber) 52 and the second chamber (agitating chamber) 53 by a partition wall 51 whose inner parts are extending in the perpendicular direction.

In the first chamber 52 there is arranged a nonmagnetic developing sleeve 54, which rotates in the direction of the arrow, and inside the developing sleeve 54 there is fixedly arranged a magnet 55.

The developing sleeve 54 carries a layer of the two-component developer (including magnetic carrier and nonmagnetic toner), which is regulated in a layer thickness by a blade 56, and supplies the developer to the photosensitive drum 40 in the developing area opposite to the photosensitive drum 40 and develops the electrostatic latent image. In order to enhance a developing efficiency, that is, a ratio of the toner given to the latent image, a developing bias voltage where the direct current voltage from a power source 57 is multiplexed with an alternative current voltage is inputted in the developing sleeve 54.

The first chamber 52 and the second chamber 53 have a developer agitating screws 58 and 59 installed inside respectively. The screw 58 agitates and carries the developer inside the first chamber 52, and the screw 59 agitates and carries the toner 63 supplied from a toner exhaust port 61 of a toner replenishing vessel 60 which will be described later, by rotation of the conveying screw 62 and the developer 43 already inside the developing device, thereby making the toner density uniform.

In the partition wall 51, developer passages (not shown) whereby the first chamber 52 and the second chamber 53 are communicated mutually at the end portions in the front side and the rear side in FIG. 2 are formed and, by conveying forces of the above described screw 58 and 59, the developer inside the first chamber 52 where the toner density is lowered by consumption of the toner by development is moved from one passage to the inside of the second chamber 53 and the developer where the toner density is restored inside the second chamber 53 is moved from the other passage to the inside of the first chamber 52.

Now, in order to compensate for changes in the developer density inside of the developing device 44 by development of the electrostatic latent image, that is, in order to control the toner amount to be supplied to the developing device 44, in the present embodiment, the developer density control device of the inductance detection system is disposed in such a manner that the inductance head 20 is installed at the bottom wall of the first chamber (developing chamber) 52 of the developing device 44 and, by an output signal from the inductance head 20, the actual toner density of the developer 43 inside the developing device 44, to be more concrete, inside the first developing chamber 52 is detected, thereby replenishing the toner in such way that the toner density has a specified value in contrast to a reference value.

As above-described, the two-component developer mainly comprises the magnetic carrier and the nonmagnetic carrier and, when the toner density (a ratio of toner grains weight to a total weight of the carrier grains and the toner grains) of the developer 43 changes, the apparent permeability due to the mixing ratio of the magnetic carrier and the nonmagnetic carrier changes.

When this apparent permeability is detected by the inductance head 20 and converted into an electrical signal, this electrical signal (a sensor output voltage (V)) approximately linearly changes in response to the toner density (T/C ratio (%)). That is, the output electrical signal from the inductance head 20 corresponds to the actual toner density of the two-component developer in the developing device 44.

This output electrical signal from the inductance head 20 is supplied to one input of a comparator 21. To the other input of the comparator 21, the reference electrical signal corresponding to the apparent permeability in the regulated toner density (the toner density in the initialization value) of the developer 43 is inputted from the reference voltage signal source 22.

Accordingly, the comparator 21 compares the regulated toner density and the actual toner density inside the developing device and the detection signal of the comparator 21 resulting from the comparison of both signals is supplied to a CPU 67 as a developer density control means.

The CPU 67, based on the detection signal from the comparator 21, controls the next toner replenishment time in a compensable manner. For example, when the actual toner density of the developer 43 detected by the inductance head 20 is smaller than the regulated value, that is, when the toner is running short, the CPU 67 activates the conveying screw 62 of a toner replenishing vessel 60 so that the toner which is running short is replenished inside the developing device 44.

That is, the CPU 67, based on the detection signal from the comparator 21, calculates a screw rotating time required for replenishing the toner running short inside the developing device 44 and, by controlling a motor drive circuit 69, rotatingly drives a motor 70 only for that calculated time so as to replenish the toner running short inside the developer 44.

Also, when the actual toner density of the developer 43 detected by the inductance head 20 is larger than the regulated value, that is, when the toner is in over-supply, the CPU 67 calculates the over-supplied toner amount inside the developer based on the detection signal from the comparator 21.

At the time of an image forming by an original thereafter, the CPU 67 performs a control in such a manner that the toner is replenished in such way that the over-supplied toner amount is lessened or an image is formed without replenishing the toner till the over-supplied toner amount is consumed and, when the over-supplied toner is consumed, the drive operation of the toner replenishment is performed as described above.

Figure 5:
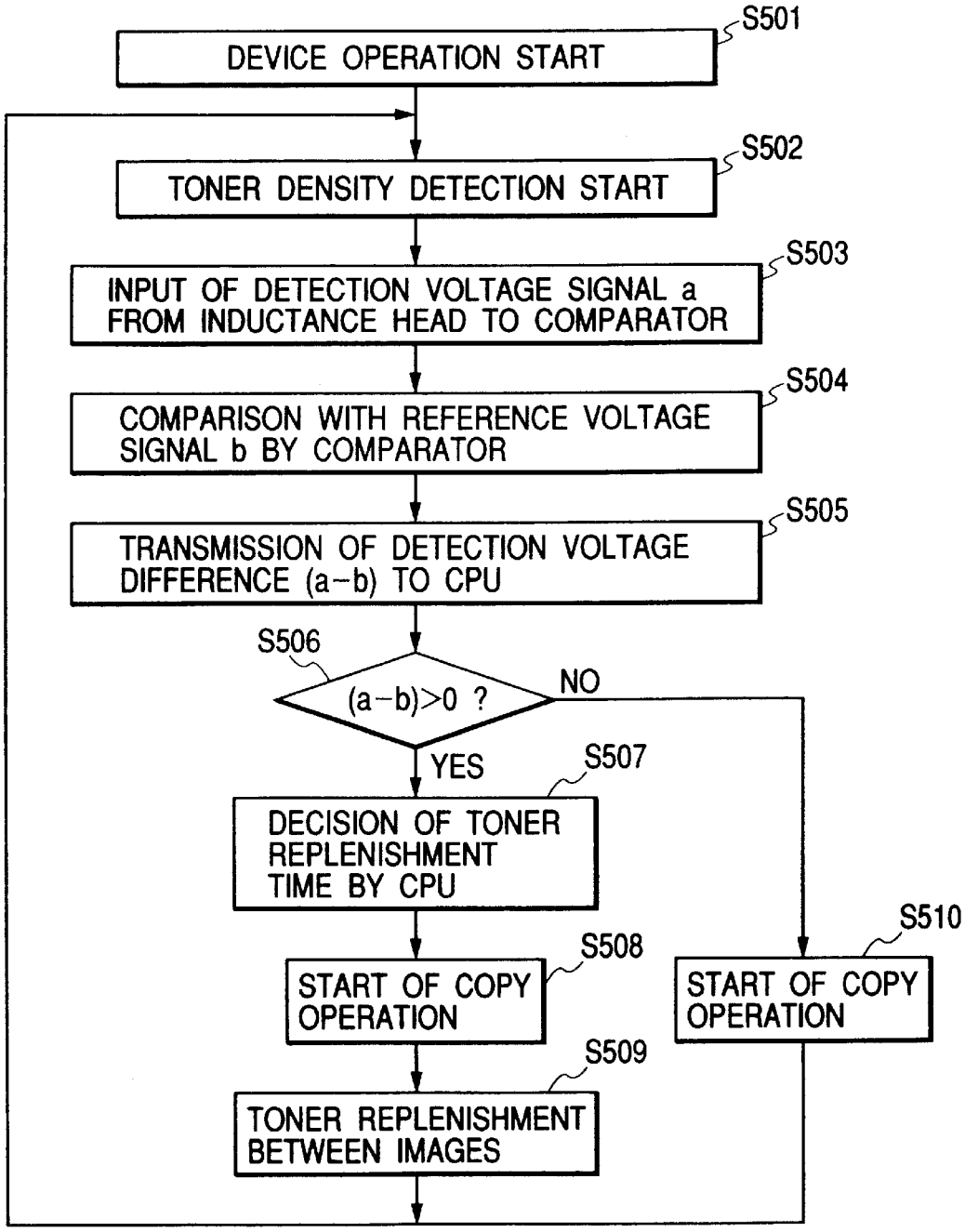
FIG. 5 is a flowchart explaining a basic drive operation of developer density control means.

Next, the above described drive operation will be described further in detail with reference to FIG. 5.

First, when the image forming apparatus starts by turning the image forming apparatus on (S501), a toner density detection starts (S502).

Then, a detection voltage signal a from the induction head 20 is inputted to the comparator 21 (S503) and, in the comparator 21, it is compared with a reference voltage signal b by the reference voltage signal 22 (S504) and its detection signal difference is determined whether it is (a−b) >0 (S506) and, when the toner density is lower than the reference value (YES), a toner replenishment time is decided (S507).

Then, by pushing a copy button of the apparatus, a copy drive operation starts (S508) and the toner is replenished between the images only for the replenishing time decided by S507 (S509) and the drive operation returns to a start.

Furthermore, when the toner density is higher than a reference value in S506 (NO), a copy drive operation starts (S510), and any toner is not replenished and the drive operation returns to the start.

Note that the timing for the toner density detection may be immediately before the copy drive operation restarts or during the copy drive operation. For example, it may be immediately before the copy drive operation restarts for the first sheet of the image forming drive operation and, thereafter, during the copy drive operation for subsequent sheets.

Also, the inductance detection ATR used in the present embodiment controls a reference value of the detection signal in an optimum toner density (which is 6% in the present embodiment. Problems can arise from the fact that when the density is higher than this value, the scattering of the toner occurs and when it is too low, an image density becomes thin.) to become 2.5 V and, when the detection signal of a sensor is higher than the reference value (for example, 3.0 V), the toner is replenished and, when the detection signal of the sensor is smaller (for example, 2.0 V), the toner replenishment stops. However, the present invention is not limited to the above described signal process and, when the toner density is lower than the optimum value, the detection signal of the sensor may be made smaller and, when the toner density is larger than the optimum density, it may be made larger.

Hereinafter, an image density control and a faulty image prevention function using the detection output of the above described inductance detection ATR will be described in detail.

As above-described, while the inductance detection system detects the changes of the apparent permeability of the developer adjacent to the sensor and controls the toner replenishment, the experiment conducted by the present inventors reveals that this apparent permeability undergoes considerable changes before and after the developer is left for a long period under a high humidity environment even if the toner does not change.

This phenomenon occurs because the physical property of the developer undergoes changes while the developer is left for a long period and the main changes in the physical property are changes in a bulk density (porosity, cohesive degree).

It is also found that factors for changing the bulk density are almost the changes in the triboelectrification amount of the toner.

Figure 6:
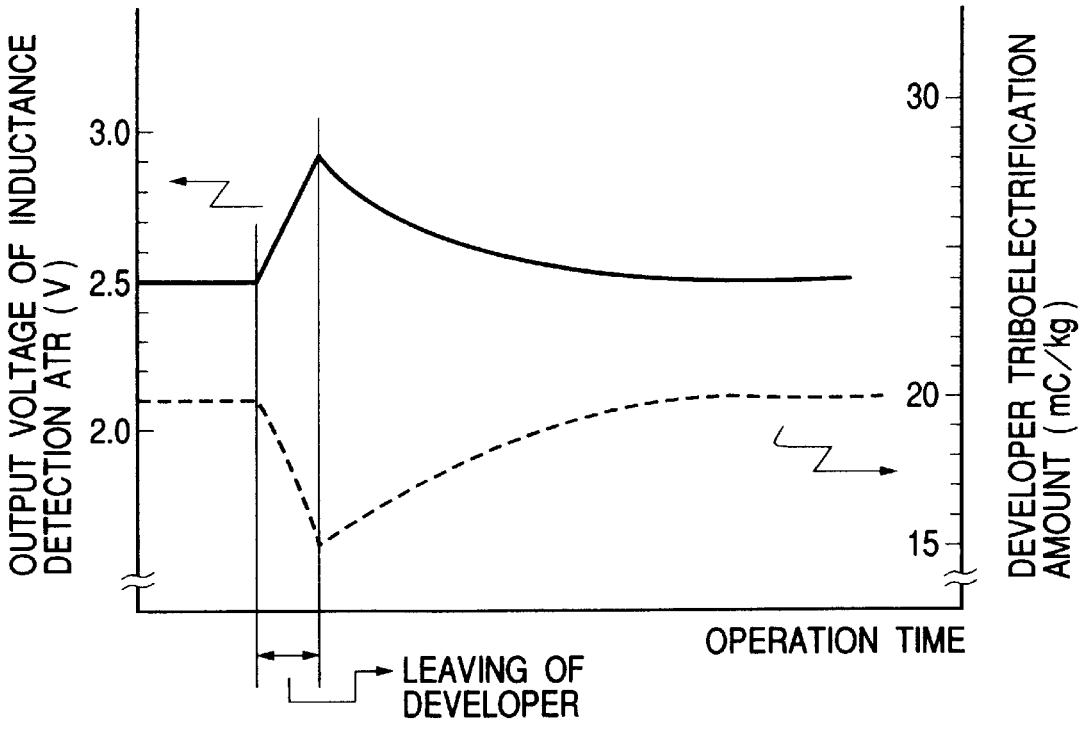
FIG. 6 is a drawing showing a sensor detection signal of an inductance detection ATR before and after the developer is left for a long period and the changes in a troboelectrification amount of the developer.

In FIG. 6, the output of the inductance detection ATR before and after the developer is left for a long period is shown. As is evident from FIG. 6, it is clear from the changes in the output amount that the output immediately after the developer is left increases approximately by 0.4 V in contrast to the output immediately before the developer is left, and there occur considerable changes in the physical property, that is, the changes in the electrification amount.

While the toner replenishment amount can be compensated from the changes in the output amount, the present invention is characterized in that it not only compensates and controls the toner replenishment amount, but also changes other image forming process condition. That is, when it is found that the developer has changed after it was left for a long period, not only the toner replenishing amount is compensated so that the changed developer becomes an optimum developer, but also the process condition is changed to optimum image forming process condition for the changed developer.

This image forming process condition is, in the present embodiment, for example, a developing contrast electric potential (a difference between a developing bias and a light portion electrical potential) and a fog taking electrical potential (a difference between a developing bias and a dark portion electrical potential). To describe it more concretely, it is a latent image potential on the photosensitive member and it can be changed by a charge potential (the dark portion electrical potential) and an exposure potential (the light portion electrical potential). The contrast potential and the fog taking potential may also be changed by changing a DC bias of the development.

Note that the above-described contrast potential and the fog taking potential may be changed to any level in response to the differences of the inductance detection output before and after the developer is left for a long period, and an density stabilization and the fog prevention may be performed.

Also, other than the above described process conditions or together with them may be fed back to a transfer condition at the same time. To be more concrete, a transfer current or a transfer voltage may be changed in response to the differences in the inductance detection output.

Figure 7:
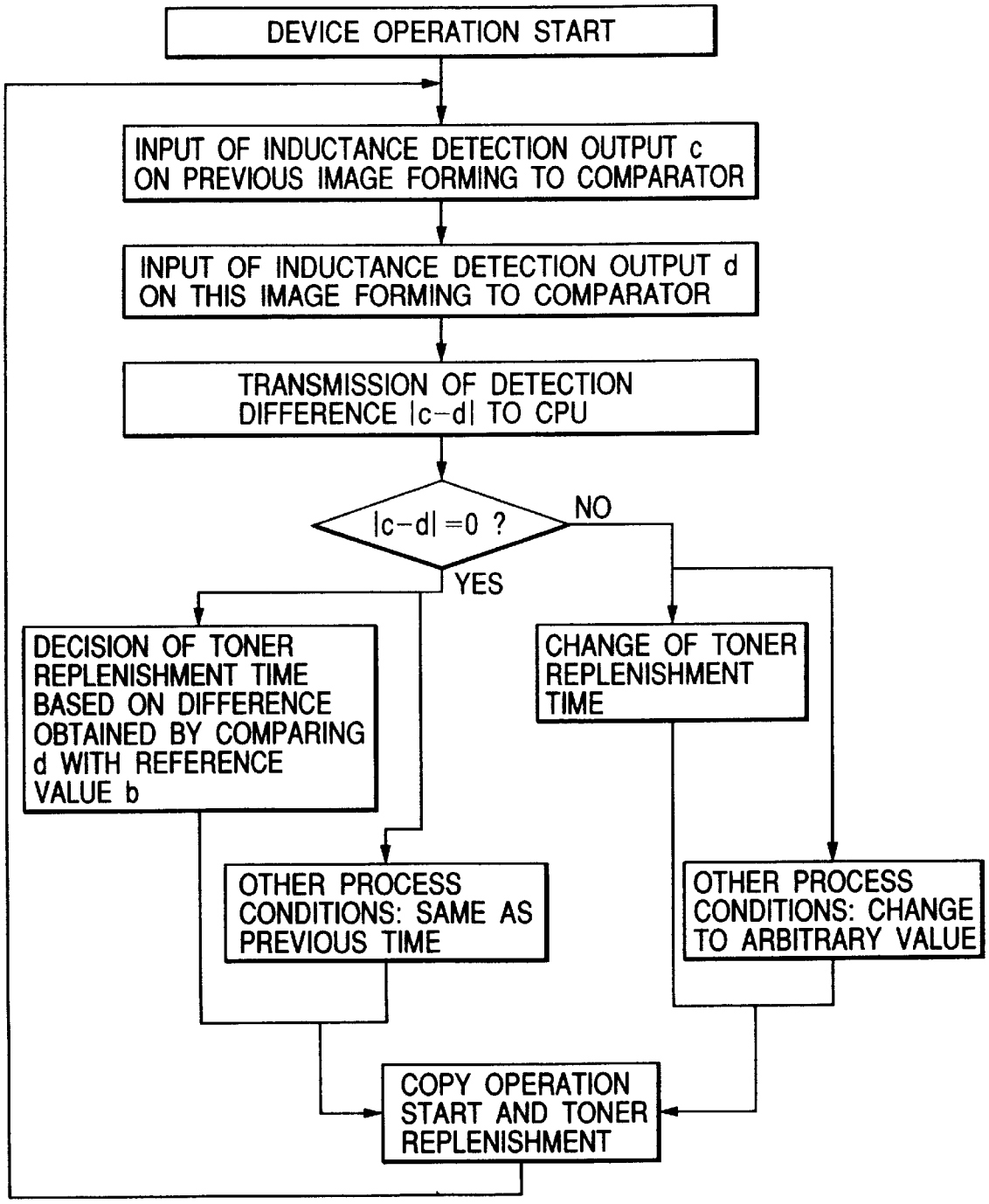
FIG. 7 is a flowchart explaining a drive operation of the developer density control means to which the present invention is adapted.

The schematic flowchart of the above described control is shown in FIG. 7.

Because of this control, the faulty image immediately after the developer is left for a long period can be prevented.

Note that, in the present embodiment, because the detection signal of the developer control apparatus immediately after the drive operation of the image forming apparatus stops is stored in a nonvolatile memory as a storing means, even when a main power source of the image forming apparatus is left in a state of being turned off, the detection signal after the drive operation of the apparatus restarts can be compared.

To describe more about the timing of the inductance detection, during the previous image forming drive operation and immediately before the previous image forming drive operation stops at a time, for example, when the developing sleeve starts rotating and the screw starts rotating, the inductance head 20 performs the previous detection. After the previous image forming drive operation stops, the main power source of the apparatus is turned off, for example, and the apparatus is left for a long period and, then, after the main power source is turned on and before the next image forming drive operation starts, the inductance head 20 performs the next detection. Accordingly, practically no differences exist in the toner consumption inside the developer between the previous detection and the next detection and it is thus possible to detect the changes in the physical property of the developer.

(Embodiment 2)

While, the above described embodiment 1 changed not only the compensation and the controlling of the toner replenishment amount, but also other image forming process condition from the changes in the amount of the detection output of the inductance detection ATR before and after the developer is left for a long period, a second embodiment controls the changed image forming process condition so as to restore the original process condition after a specified time elapses.

The bulk density of the developer even in the case where the environment such as a temperature and a humidity changes largely and a packing and the electrification amount are lowered because the developer is left grows accustomed to the environment as the drive operation of the normal image forming apparatus continues and is considered to gradually approach to the bulk density suitable for the environment due to a dissolution of the packing of the developer through agitation and restoration of the toner electrification amount.

Accordingly, by restoring the changed process condition immediately after the developer is left for a long period to the original process condition after the specified time elapses, the bulk density grows accustomed to the environment and can stabilize the image density even when the bulk density is in a stabilized state (the electrification amount is restored).

Note that the above-described specified time is decided based on the number of specified image forming sheets and, for example, by restoring the original process condition after 100 sheets, both the image density immediately after the bulk density can be controlled to have a desired value.

For example, after the toner replenishment amount and the image forming process condition have been changed, the continuous copying of the specified number of recording members having one hundred sheets is performed and, thereafter, the toner replenishment amount and the image forming process may be restored to the original process condition.

Also, because the restoration of the bulk density of the developer directly relates to the driving of an agitating member, by setting the timing for restoring the condition to the original process condition after the total agitating time of the agitating member elapsed ten minutes, both the image density immediately after the bulk density changes largely when the developer is left and the image density in a stabilized condition of the bulk density due to a large amount of image forming drive operations thereafter can be controlled to have a desired value.

Also, the control by the video count system is possible. In such a system, because the number of video counts is proportional to the toner consumption amount, the shape and the surface property of the toner change as a result of the fact that the toner has been caught between carriers and pressed down, for example, as the developer is left for a long period, even when the bulk density changes, the toner is consumed and newly replenished so that the toner returns to the original bulk density.

Hence, by setting the timing for restoring the condition to the original process condition, for example, after the integrated value of the video count becomes constant, both image density immediately after the bulk density changes largely when the developer is left idle and the image density in a stabilized condition of the bulk density due to a large amount of image forming drive operations thereafter can be controlled to have a desired value.

(Embodiment 3)

Next, an embodiment 3 of the present invention will be described with reference to FIG. 8. The configuration of the present embodiment is characterized in that the developing sleeve 54, which is a developer carrying member, is rotated in the reverse direction (counter direction) to the rotating direction of the photosensitive member as shown in FIG. 8.

Figure 8:
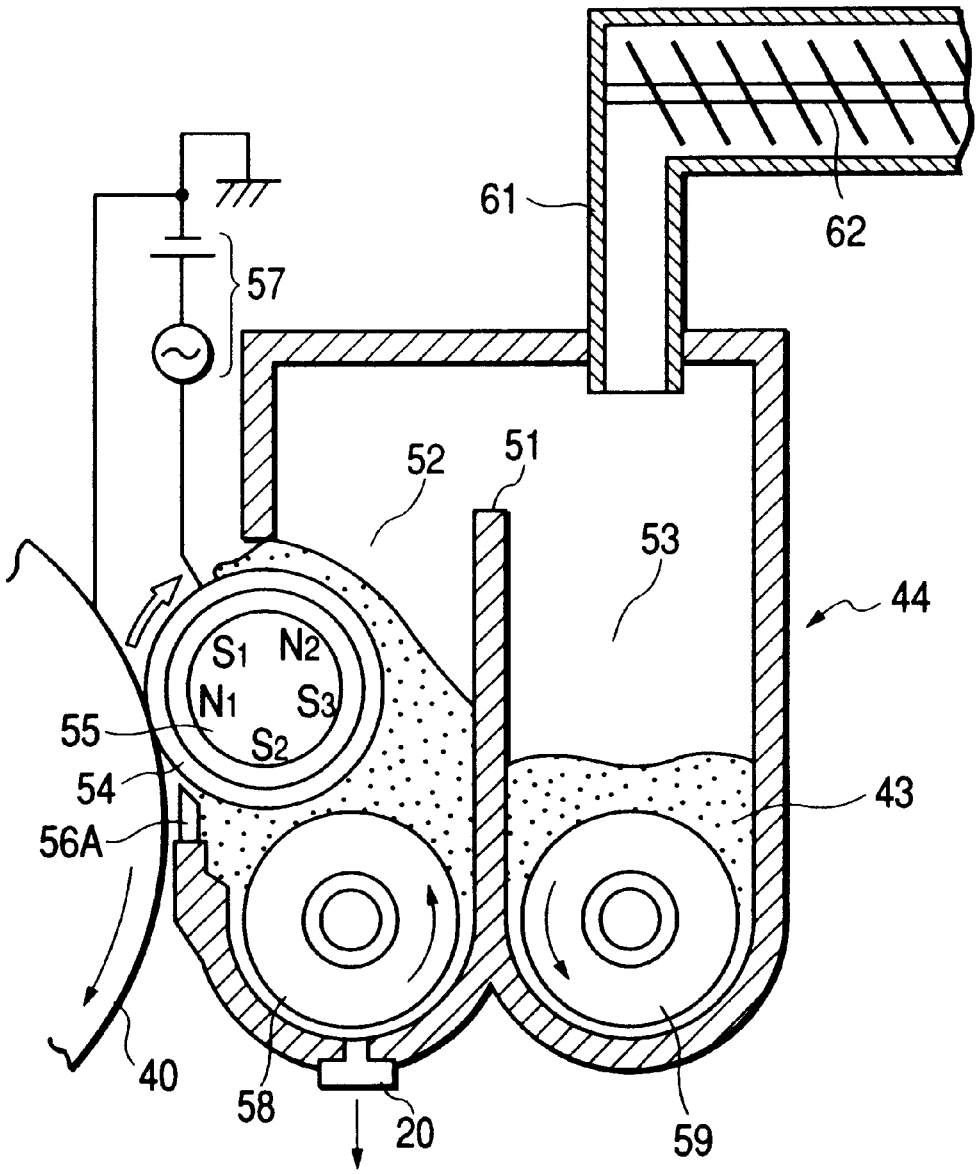
FIG. 8 is a drawing showing a rotating direction of a developer sleeve and a photosensitive drum according to a third embodiment.

As shown in FIG. 8, in the configuration where the developing sleeve 54 is rotated in the reverse direction to the rotating direction of the photosensitive member, the developer 43 of the developing chamber 52 is conveyed by using a S2 polarity and, after the developer 43 is coated on the developing sleeve 54, the developer 43 coated on the developing sleeve 54 by a blade 56*a*, which is a developer regulating member, is regulated, thereby controlling a coating amount on the developing sleeve 54.

For this reason, in the configuration where the developing sleeve 54 rotates forward in the rotating direction of the photosensitive member as shown in FIG. 2, the developer clogs by turns in the vicinity of the regulating blade 56, whereas the compressing of the developer in the vicinity of the regulating blade 56 of the developing sleeve 54 is lessened and, as a result, deterioration of the developer can be prevented and fluctuation of the toner electrification amount can be controlled.

This is related to the fact that the changes in the bulk density of the developer by the changes in the toner shape or the changes in the toner electrification amount by the compressing of the toner can be controlled and the changes in the bulk density by mutual repulsion of the toner are reduced. Contrary to the conventional system where the sleeve rotates forward for the photosensitive drum, the sensor detection signal errors after the drive operation of the inductance detection system restarts can be controlled to the lowest degree and there is no need to change the process condition.

(Embodiment 4)

Next, an embodiment 4 of the present invention will be described with reference to FIGS. 9A and 9B. The present embodiment is characterized in that the changing of the material and the physical property of the carrier can control the toner electrification amount.

Figure 9A:
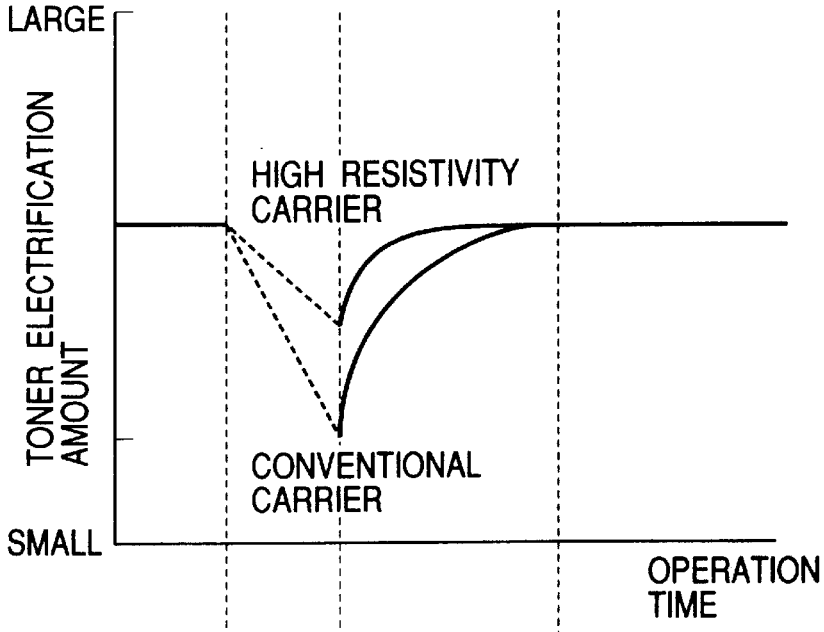
FIG. 9A shows a fluctuation of a toner electrification amount for a ferrite system magnetic carrier conventionally used and a high resistivity carrier according to a fourth embodiment before and after the image forming drive operation stops and restarts.
Figure 9B:
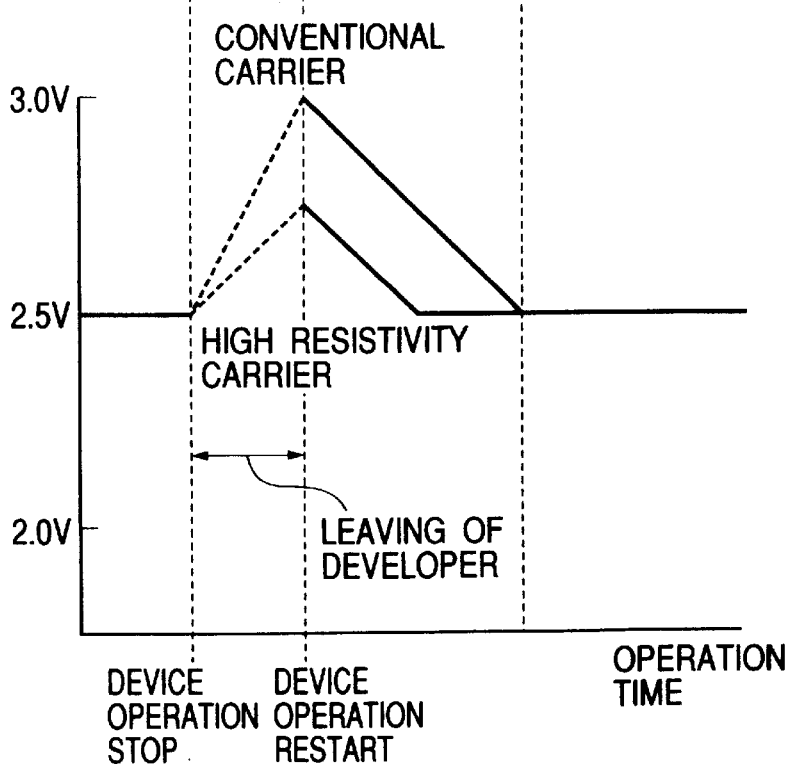
FIG. 9B is a drawing showing changes in a sensor detection signal of an induction detection ATR.

FIGS. 9A and 9B show the difference between the conventionally used ferrite system magnetic carrier and the high resistivity carrier which could control the changes in the triboelectrification amount and also the difference between the changes in the toner electrification amount when the developer is left and the corresponding sensor detection signals before the apparatus drive operation stops and immediately after the apparatus drive operation restarts.

The present inventors examined the cause of such differences as follows. The high resistivity carrier and the ferrite system magnetic carrier of the present embodiment are different in its resistivity. The resistivity of the ferrite system magnetic carrier is $1\times10^{9}$ to $1\times10^{10}$ Ω·cm and the resistivity of the carrier itself is low, while the resistivity of the high resistivity carrier is $1\times10^{10}$ to $1\times10^{14}$ Ω·cm and its resistivity is high and, therefore, an electric charge is hard to escape once stored inside the carrier and the fluctuation of the electric charge inside the carrier is lessened at a time when the developer is left and, as a result, the fluctuation of the toner electrification amount is lessened.

Note that, while the present inventors formed the above described high resistivity carrier by a method of polymerizing binder resin, magnetic metal oxide and nonmagnetic metal oxide, the carrier may be not used if the resistivity can be controlled by another manufacturing method.

Note also that, while each of the above described embodiments show the case where the present invention is adapted to the digital copying machine of the electrophotographic system, the present invention can be equally adapted to the image forming apparatus other than the present embodiment such as various kinds of copying machines, printers or the like of the electrophotographic system, the electrostatic recording system or the like.

For example, the present invention can be adapted to the image forming apparatus which performs an image gradation by a dither method and also to the image forming apparatus which forms toner images by the image information signal outputted from a computer or the like. Moreover, with respect to the configuration of the image forming apparatus and the control system, a variety of deformations and changes can be made as occasion demands.

As described above, the developer density control means detect the physical property of the developer and, when it determined that the detection result changed immediately after the drive operation of the image forming apparatus restarts when it has stopped and restarts against the detection result immediately before the image forming drive operation stops when it stops, it controls the image forming process condition of the image forming drive operation immediately after the image forming drive operation restarts based on the difference between the detection result immediately before the image forming drive operation stops and immediately after the image forming drive operation restarts and, therefore, can prevent the faulty image immediately before the image forming drive operation restarts and keeps the image density adequate, thereby enabling to provide a high quality image forming apparatus capable of obtaining an excellent image for a long period.

Also, the developer density control means reliably detect the changes in the physical property of the developer immediately after the developer is left under a high humidity environment for a long period and, based on its detection result, not only compensates for the toner replenishment amount, but also changes the image process condition and, therefore, can always stabilize the image density and provide an excellent image without fog or roughness.

What is claimed is:

1. An image forming apparatus, comprising:

image forming means for forming an image on a recording material including: an image bearing member, and developing means for developing an electrostatic image formed on said image bearing member by a developer; and density detection means for detecting a developer density inside said developing means, which is capable of detecting a parameter relating to physical property of the developer;

wherein, based on a previous detection value detected by said density detection means during previous image forming drive operation by said image forming means and before said previous image forming drive operation stops and a next detection value detected by said density detecting means after said previous image forming drive operation stops and before a next image forming drive operation by said image forming means starts, the image forming condition of said next image forming drive operation is controlled to be variable.

2. The image forming apparatus according to claim 1, wherein said image forming condition of said next image forming drive operation is controlled based on the difference between said previous detection value and said next detection value.

3. The image forming apparatus according to claim 1, wherein said apparatus comprises control means for controlling the developer density inside said developing means based on the detection result detected by said density detection means.

4. The image forming apparatus according to any one of claim 1 to claim 3, wherein said developer comprises: a nonmagnetic carrier; and a magnetic carrier, and said parameter is an apparent permeability of said developer, and said control means control the toner replenishment to the inside of said developing means based on the detection result of said density detecting means.

5. The image forming apparatus according to claim 4, wherein said control means controls said developer density to be variable based on said previous detection value and said next detection value.

6. The image forming apparatus according to claim 1, wherein said image forming means comprises electrostatic image forming means for forming said electrostatic image on said image bearing member, and said image forming condition is at least one from electrostatic image forming condition of said electrostatic image forming means and the developing condition of said developing means.

7. The image forming apparatus according to claim 6, wherein said image forming condition is at least one from a developing contrast potential and a developing back-contrast potential.

8. The image forming apparatus according to claim 6, wherein said image bearing member is the photosensitive member, and said electrostatic imaging forming means comprises: electrification means for electrifying said image bearing member, and exposure means for exposing said image bearing member, and said electrostatic image forming condition is at least one from the electrification condition of said electrifying means and the exposure condition of said exposing means.

9. The image forming apparatus according to claim 1, wherein said image forming means comprises transfer means for transferring an image on said recording material from said image bearing member and said image forming condition is the transfer condition of said transfer means.

10. The image forming apparatus according to claim 1, wherein the next image forming condition is restored to the image forming condition of said previous image forming drive operation after the image forming condition of said next image forming drive operation is changed to the image forming condition of said previous image forming drive operation and images are formed on recording material having the specified number of sheets by said next image forming drive operation.

11. The image forming apparatus according to claim 1, wherein the next image forming condition is restored to the image forming condition of said previous image forming drive operation after the image forming condition of said next image forming drive operation is changed to the image forming condition of said previous image forming drive operation and images are formed continuously on recording material having the specified number of sheets by said next image forming drive operation.

12. The image forming apparatus according to claim 10 or claim 11, wherein said developing means comprises a developer agitating member for agitating the developer inside said developing means and said specified number of sheets are decided according to the drive operation time of said developer agitating member.

13. The image forming apparatus according to claim 10 or claim 11, wherein said electrostatic images are formed on said image bearing member based on the image signals and said specified number of sheets are decided according to the number of video counts of said image signals.

14. The image forming apparatus according to claim 1, wherein said developing means comprises a developer bearing member for bearing the developer in a developing location and rotates in the reverse direction to said developer bearing member and said image bearing member in said developing location.

15. The image forming apparatus according to claim 5, wherein the volume resistivity of said carrier is $1\times10^{10}$ to $1\times10^{14}$ Ωcm.

16. The image forming apparatus according to claim 5, wherein said carrier is formed by a method of polymerizing resin magnetic carrier comprising: binder resin; magnetic metal oxide; and nonmagnetic metal oxide.

17. The image forming apparatus according to claim 1, wherein said apparatus comprises storing means for storing said previous detection value.

* * * * *

UNITED STATES PATENT AND TRADEMARK OFFICE

CERTIFICATE OF CORRECTION

PATENT NO. : 6,377,762 B2
DATED : April 23, 2002
INVENTOR(S) : Yoshiaki Kobayashi et al.

It is certified that error appears in the above-identified patent and that said Letters Patent is hereby corrected as shown below:

Title page,
Item [57], ABSTRACT,
Line 2, "medium such," should read -- medium, such --.

Column 1,
Line 63, "system" should read -- systems --.

Column 2,
Line 3, "converted" should read -- being converted --.

Column 3,
Line 14, "change" should read -- changes --;
Line 39, "adopted;" should read -- adapted; --;
Line 43, "methods" should read -- method --; and
Line 52, "troboelectrifi-" should read -- triboelectrifi- --.

Column 5,
Line 27, "thereby" should read -- whereby --; and
Line 62, "not shown" should read -- (not shown) --.

Column 6,
Line 21, "have a" should read -- have --.

Column 9,
Line 11, "and an" should read -- and a --;
Line 49, "While," should read -- While --;
Line 61, "is" should be deleted; and
Line 64, "to" should be deleted.

Column 10,
Line 11, "immediately after" should read -- and, immediately after, --.

Column 11,
Line 46, "be not" should read -- not be --; and
Line 67, "determined" should read -- is determined --.

UNITED STATES PATENT AND TRADEMARK OFFICE

CERTIFICATE OF CORRECTION

PATENT NO. : 6,377,762 B2
DATED : April 23, 2002
INVENTOR(S) : Yoshiaki Kobayashi et al.

It is certified that error appears in the above-identified patent and that said Letters Patent is hereby corrected as shown below:

Column 12,
Line 5, "immediately" should be deleted;
Line 6, "after the image forming drive operation" should be deleted;
Line 56, "carrier;" should read -- carrier --; and
Line 58, "control the" should read -- controls the --.

Signed and Sealed this

Eighth Day of October, 2002

*Attest:*

*Attesting Officer*

JAMES E. ROGAN
*Director of the United States Patent and Trademark Office*